United States Patent [19]

Pav et al.

[11] 4,425,489

[45] Jan. 10, 1984

[54] ELECTROMAGNETIC HEATING SYSTEM FOR CALENDER ROLLS OR THE LIKE

[75] Inventors: Josef Pav, Krefeld; H. J. Lauschner, Ratingen; Peter J. Gaede, Munich, all of Fed. Rep. of Germany

[73] Assignee: Kleinewefers GmbH, Krefeld, Fed. Rep. of Germany

[21] Appl. No.: 294,742

[22] Filed: Aug. 20, 1981

[30] Foreign Application Priority Data

Sep. 5, 1980 [DE] Fed. Rep. of Germany ..... 3033482

[51] Int. Cl.[3] ..... H05B 6/14

[52] U.S. Cl. ..... 219/10.49 A; 219/10.61 A; 219/10.79; 219/10.77; 219/471

[58] Field of Search ..... 219/10.49 A, 10.61 A, 219/10.49 R, 10.61 R, 10.75, 10.77, 469, 470, 471, 10.57, 10.79

[56] References Cited

U.S. PATENT DOCUMENTS

| | | | |
|---|---|---|---|
| 3,200,230 | 8/1965 | Bretonière | 219/10.49 A |
| 3,369,106 | 2/1968 | Troll | 219/471 |
| 3,515,837 | 6/1970 | Ando | 219/10.49 R |
| 3,581,060 | 5/1971 | Bauer | 219/10.61 A X |
| 3,758,738 | 9/1973 | Otani et al. | 219/10.61 X |
| 3,821,508 | 6/1974 | Hagerty | 219/10.49 R |
| 3,824,366 | 7/1974 | Garnier | 219/10.77 |
| 4,105,896 | 8/1978 | Schuster | 219/471 X |
| 4,307,276 | 12/1981 | Kurata et al. | 219/10.77 X |
| 4,350,861 | 9/1982 | Pouillange et al. | 219/10.75 X |

OTHER PUBLICATIONS

German Publication "VDI-Bildungswerk", BW 1407, Collin, (date unknown).

*Primary Examiner*—B. A. Reynolds
*Assistant Examiner*—Philip H. Leung
*Attorney, Agent, or Firm*—Kontler, Grimes & Battersby

[57] ABSTRACT

A calender roll whose shell consists of ferromagnetic material is heated by several groups of electromagnets which are mounted within the shell on a stationary carrier and whose pole shoes are adjacent to the internal surface of the shell. The temperature of the external surface of the shell is monitored at several locations as considered in the axial direction of the roll, and the resulting signals are compared with reference signals denoting the optimum or desired temperatures at such locations. Signals denoting the differences between the actual temperature signals and desired temperature signals are used to regulate the characteristics of electric current which is supplied to the windings of the electromagnets. Each electromagnet of each group can be regulated independently of all other electromagnets. Alternatively, two or more electromagnets of each group or entire groups of electromagnets may be regulated simultaneously. Additional electromagnets are provided to heat the end portions of the shell. Alternatively, such end portions can be heated by the rotors of electric motors which rotate the shell. The characteristics of current which is supplied to the windings of certain electromagnets can be influenced by signals which denote the magnitude of flexural stresses upon selected portions of the shell so that the corresponding electromagnets oppose deformation of adjacent portions of the shell.

17 Claims, 4 Drawing Figures

ELECTROMAGNETIC HEATING SYSTEM FOR CALENDER ROLLS OR THE LIKE

BACKGROUND OF THE INVENTION

The present invention relates to rolls, especially to rolls for use in calenders or analogous machines. More particularly the invention relates to improvements in systems for heating the rotary envelopes or shells of calender rolls or the like. Still more particularly, the invention relates to improvements in systems for electromagnetic heating of shells which form part of calender rolls or the like.

It is already known to heat the ferromagnetic shell of a calender roll by resorting to a set of magnets, especially electromagnets, whose pole faces are adjacent to a surface of the shell and which serve to induce currents in the material of the shell.

German publication entitled "VDI-Bildungswerk BW 1407" discloses the results of systematic testing of a calender roll which is heated by inducing heating currents in its rotary shell. The tests involved placing the winding of an electromagnet around the shell of the calender roll and the utilization of a plurality of U-shaped magnetic yokes which were caused to overlie the winding and to extend in the axial direction of the shell. The shell constituted an annular conductor for the heating current. The heating action was not satisfactory so that the aforementioned publication already contains a proposal to replace the magnetic heating system with a system which employs a circulating hydraulic fluid.

Heating systems which rely on a circulating hydraulic fluid exhibit the drawback that they cannot ensure the maintenance of a constant temperature or of a predictable pattern of temperatures along the periphery of the shell, i.e., in the region where the shell of a calender roll acts upon a running web of paper, textile or a like material. The main reason for such inability of a hydraulic heating system to ensure the establishment and maintenance of a constant temperature of a predictable pattern of temperatures along the external surface of the shell is that the temperature of the fluid changes during flow through the roll. Attempts to uniformize the temperature of the conveyed fluid, as considered in the axial direction of the shell, have met with limited success. Moreover, such uniformizing techniques are satisfactory only when the temperature of the external surface is to be maintained within a narrow band of the full range of desirable or required temperatures.

OBJECTS AND SUMMARY OF THE INVENTION

An object of the invention is to provide a novel and improved electromagnetic system for heating the shells of calender rolls or the like.

Another object of the invention is to provide a heating system which can automatically maintain the temperature of the shell within an optimum range for any desired periods of time.

A further object of the invention is to provide a heating system which can be installed in or combined with many types of rolls, such as those used in calendering or analogous machines for the treatment of paper webs, webs of textile material and/or other types of strip-shaped material.

An additional object of the invention is to provide an electromagnetic heating system which is relatively simple, compact and reliable and requires no attention or a minimum of attention on the part of attendants.

A further object of the invention is to provide a heating system which can be installed in existing calenders or like machines as a superior substitute for the presently known heating systems for the shells of calender rolls or the like.

An additional object of the invention is to provide a heating system which can ensure uniform heating of a roll all the way from the one to the other axial end thereof or a heating action which varies in accordance with a predetermined pattern.

An ancillary object of the invention is to provide a novel and improved array of magnets which can be utilized in a heating system of the above outlined character.

Another object of the invention is to provide novel and improved means for controlling the heating action of electromagnets in the above outlined heating system.

The invention is embodied in a roll, particularly in a calender roll, which comprises a hollow cylindrical shell consisting of ferromagnetic material and having an internal surface and an external surface, and novel and improved heating means for the shell. The heating means comprises a plurality of groups of magnets, preferably electromagnets, which are adjacent to at least one of the two surfaces and form a row extending in substantial parallelism with the axis of the shell. At least a portion of the external surface of the shell is left unobstructed so that such portion can form with an adjacent shell a nip for the passage of a running web of paper, textile material or the like. Each of the aforementioned groups comprises a plurality of discrete magnets each of which induces a magnetic flux in the respective portion of the shell. The heating means further comprises adjustable means for regulating the magnetic flux which is induced by the magnets of at least some of the groups independently of the magnetic flux which is induced by the other groups (for example, the regulating means can adjust each and every magnet of each group, pairs of other arrays of magnets in each group, all magnets of entire groups, or all or selected magnets of pairs of neighboring groups, depending on the desired degree of accuracy of regulation of the heating action and the nature of treatment to which the shell subjects a running web of paper or the like). The heating means also comprises signal generating monitoring means for (directly or indirectly) ascertaining the temperature of a plurality of locations along the external surface of the shell, as considered in the axial direction of the shell, and control means having input means connected with the monitoring means and serving to adjust the regulating means in dependency on the nature of signals which are transmitted by the monitoring means (and/or in dependency on other variable parameters) so as to maintain a predetermined pattern of temperatures along the external surface of the shell (e.g., a pattern of identical temperatures from the one to the other axial end of such external surface).

The novel features which are considered as characteristic of the invention are set forth in particular in the appended claims. The improved roll itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
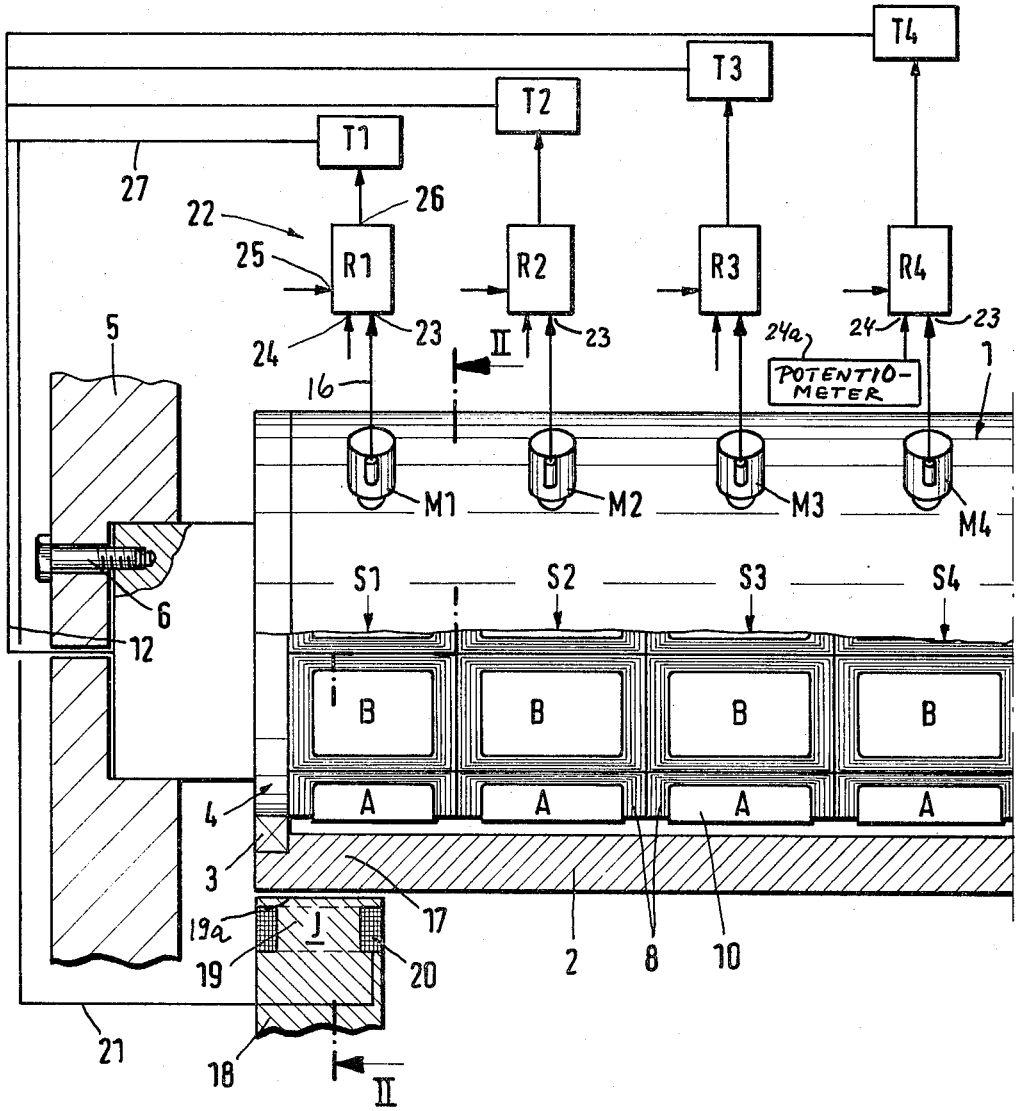
FIG. 1 is a fragmentary diagrammatic partly elevational and partly sectional view of a calender roll with a heating system which embodies one form of the invention.
Figure 2:
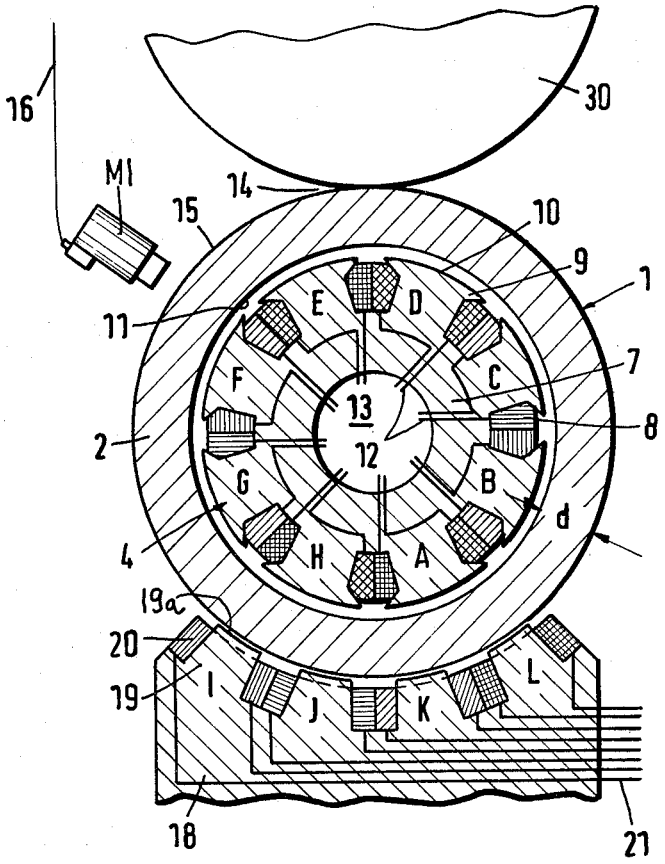
FIG. 2 is a vertical sectional view as seen in the direction of arrows from the line II—II of FIG. 1, further showing a portion of a complementary roll which cooperates with the heated roll of FIG. 1 to treat a running web of metallic, plastic, textile or other material.

Referring first to FIGS. 1 and 2, there is shown a first horizontal calender roll 1 which cooperates with a second roll 30 to define therewith a nip 14 for the passage of a web of textile material, paper or the like. The rolls 1 and 30 are installed in a frame including an upright frame member 5 a portion of which can be seen in the left-hand portion of FIG. 1.

The roll 1 comprises a hollow shell or cylinder 2 having a cylindrical internal surface 11 and a cylindrical external surface 15. The reference character d denotes the thickness of the shell 2, as considered in the radial direction of the roll 1. Such thickness will normally exceed 20 mm. The end portions 17 of the shell 2 are rotatable on suitable antifriction bearings 3 one of which is shown in the left-hand portion of FIG. 1. The illustrated bearing 3 surrounds a fixed carrier 4 which is spacedly surrounded by the shell 2 and is non-rotatably mounted in the frame member 5 (note the screw 6 which holds the carrier 4 against rotation in the frame member 5).

The carrier 4 supports several sets or groups S1, S2, S3, S4 . . . of eight discrete electromagnets A, B, C, D, E, F, G, H each. The magnets of each group form a complete annulus of equidistant magnets (see FIG. 2) with pole shoes 9 whose pole faces 10 are adjacent to the internal surface 11 of the sleeve 2. The pole shoes 9 are connected to each other by a yoke 7 which forms part of the carrier 4. The coils or windings of the magnets A to H are shown at 8; these coils are connected with conductors 12 which extend outwardly through an axial bore 13 of the carrier 4.

The groups S1, etc. of electromagnets A-H form part of the electromagnetic heating system for the shell 2. Such system further comprises a set of monitoring devices or detectors M1, M2, M3, M4 . . . , one for each of the groups S1, S2, S3, S4 . . . The detectors M1, etc. monitor the temperature of the respective portions of the external surface 15 and transmit appropriate signals (via conductors 16) to the corresponding inputs 23 of circuits R1, R2, R3, R4 . . . which together constitute a control circuit 22 for a set of adjustable current regulating circuits T1, T2, T3, T4 . . .

The monitoring devices M1, etc. which are used in combination with the roll 1 of FIGS. 1 and 2 are of the known type capable of ascertaining temperature-depending changes of the material of the shell 2 by monitoring the eddy currents therein. This renders it possible to ascertain the temperature-dependent changes of permeability and/or conductivity and/or other characteristics of the material of the shell 2. Thus, each signal which is transmitted via respective conductor means 16 is indicative of the temperature of the corresponding portion of the external surface 15 of the shell 2.

The left-hand end portion 17 of the shell 2 (as viewed in FIG. 1) is adjacent to a group or battery 18 of externally mounted additional electromagnets I, J, K and L which are located diametrically opposite the nip 14. The magnets I to L comprise pole shoes 19 which are surrounded by windings 20 and have pole faces **19*a* facing the adjacent portions of the external surface 15 of the shell 2. The windings 20 are connected with conductors 21**.

Figure 3:
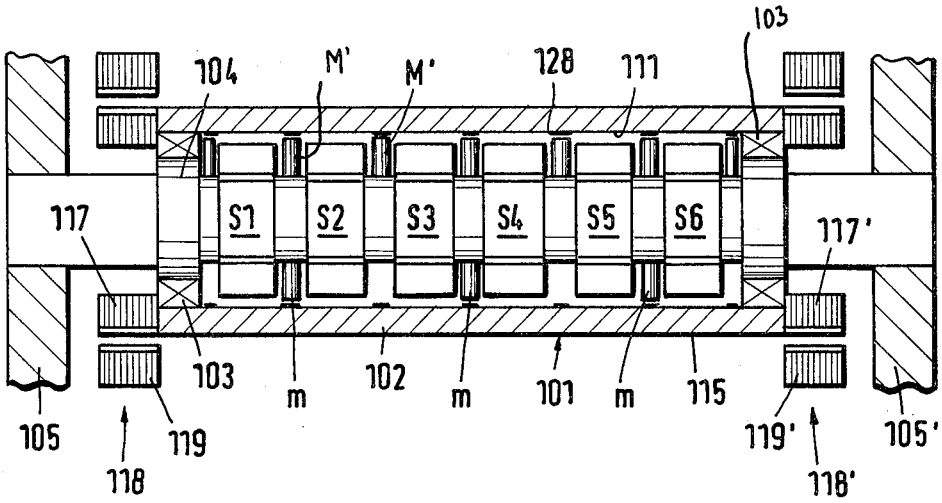
FIG. 3 is a somewhat schematic axial sectional view of a modified roll.

The first inputs 23 of the circuits R1, R2, R3, R4 . . . of the control circuit 22 are connected with the conductors 16 of the respective monitoring devices M1, M2, M3, M4 . . . Each of the circuits R1, etc. has a second input 24 which is connected with a suitable source of reference signals denoting the desired temperature of the respective portion of the external surface 15. For example, each source of reference signals may include an adjustable potentiometer (one shown at **24*a*). Third inputs 25 of the circuits R1, etc. are connected with suitable detectors which monitor the stresses upon the respective portions of the shell 2. FIG. 3 shows stress monitoring detectors m which are installed in the interior of the respective cylindrical shell 102. Such or analogous detectors are connected with the inputs 25 of the circuits R1, etc. to influence the output signals (see the outputs 26) which are transmitted to the adjustable regulating circuits T1, etc. The circuits T1, etc. control the characteristics (e.g., intensity) of the current which is supplied to the windings of the electromagnets A to H and I to L. The reference character 27 denotes one of the conductors which connect the regulating circuits T1, etc. with the corresponding groups S1, etc. of discrete magnets A-H. The output of the circuit T1 is further connected with the conductors 21 for the windings 20 of the electromagnets I to L in the battery 18. It is not always necessary that each and every winding 8 or 20** be connected to the respective regulating circuit by discrete conductor means. For example, two neighboring windings or two windings which are located opposite each other can be connected in series.

When the windings 20 receive current from the respective regulating circuits T1, etc., the ferromagnetic material (normally steel) of the shell 2 allows for the generation of eddy currents in that stratum or layer which is adjacent to the internal surface 11 of the shell 2. Such eddy currents lead to heating of the shell, and the developing heat is removed by the web of textile or other material which is caused to advance through the nip 14 of the rolls 1 and 30. The thickness d of the shell 2 is at least twice the thickness of the layer wherein the magnets A to H cause the development of eddy currents; this ensures that the transition between the regions which are heated to different temperatures is gradual, i.e., that there is no abrupt drop of temperature between a portion of the shell 2 which is heated by a given group (e.g., S1) and the neighboring portion of the shell which is heated by the corresponding group (S2) of electromagnets.

The aforementioned eddy currents develop even if all of the windings receive identical excitation currents and even if the manner of connecting the poles of all of the magnets is the same. This is due to the fact that the gaps between the pole faces cause changes in the flux. However, it is normally desirable or advantageous to establish different conditions at successive pole faces, as considered in the circumferential direction of the shell 2, so as to bring about more pronounced changes in flux. This can be achieved by changing the intensity of the excitation current or by alternating the pole faces. At any rate, it presents no problems to achieve a satisfactory heating of the material of the shell 2.

The shell of the roll 30 can be heated in the same way as the shell 2.

When the heating system of FIGS. 1 and 2 is in use, the inputs 24 of all circuits R1, etc. receive appropriate reference signals which denote the desired temperatures in the corresponding portions of the shell 2, i.e., in the corresponding regions of the external surface 15. The signals at the inputs 24 can be fixed or they may vary as a function of changes in operating conditions in a manner which is not specifically shown in the drawing. The monitoring devices M1, etc. transmit signals which denote the actual temperatures of the respective portions of the shell 2. The associated regulating circuits T1, etc. receive appropriate signals via outputs 26 of the respective circuits R1, etc. so that the intensity or another characteristic of the current which is supplied to the corresponding group of electromagnets A-H brings about an appropriate adjustment of the heating action if the monitored temperatures deviate from the desired temperatures. Additional heating by the electromagnets I to L at the end portion 17 of the shell 2 reduces the likelihood of undesirable drop of temperature in such region of the roll 1. It goes without saying that the other end portion of the shell 2 can also be heated by a battery or set of externally mounted additional electromagnets corresponding to the electromagnets I to L.

If the inputs 25 are active, i.e., if such inputs transmit additional signals which are to be processed by the circuits R1, etc. so as to influence the signals at the outputs 26, the improved roll can automatically compensate for possible flexure of the shell 2 in response to excessive or unevenly balanced stresses. For example, signals at the inputs 25 can be utilized to control the heating action of electromagnets A and H in some or all of the groups S1, etc. in such a way that these magnets oppose the bending or flexing stresses upon the respective portions of the shell 2, namely, upon the portions which contact the running web in the nip 14. The resulting eddy currents furnish some of the heating action. In such instances (i.e., when the inputs 25 transmit signals), the electromagnets D and E are deenergized. The current which flows through the magnets B, C, F and G is the same and is selected in such a way that it furnishes the balance of heating action, i.e., the heating action which is required in addition to that supplied by the energized electromagnets A and H which then perform the additional function of compensating for or counteracting the flexing or bending stresses upon the shell 2. The forces which are generated by the magnets B, C, F and G compensate or balance each other so that they do not or need not influence the configuration of the shell 2.

In the improved roll, the shell 2 underdoes an inductive heating action. Since the heating action of at least some of the groups S1, etc. can be regulated independently of the others (in fact, and if desired or necessary, the characteristics of current supplied to each and every electromagnet can be regulated independently of the other electromagnets), it is possible to select the progress of temperature along the external surface 15 of the shell 2 practically at will. The temperature monitoring devices M1, etc. cooperate with the respective sources (24*a*) of reference signals to enable the control circuit 22 to adjust the regulating circuits T1, etc. in such a way that the progress of temperature along the external surface 15 follows any desired pattern, e.g., the temperature can be constant from the one to the other axial end of the shell 2 if such mode of heating is most desirable in connection with the treatment of a particular type of paper, textile material or the like. The temperature of the external surface 15 may vary, as considered in the axial direction of the roll 1, in order to account for differences in the moisture content of the running web, as considered in a direction from the one to the other marginal portion of such web.

The mounting of electromagnets A to H in each of the groups S1, etc. on the carrier 4 exhibits the advantage that the electromagnets occupy space which is available in the interior of the shell 2 as well as that the electromagnets cannot interfere with the delivery of a running web to and with removal of the web from the nip 14 of the rolls 1 and 30. All magnets which are adjacent to the external surface 15 are installed in such a way that they leave open a path for the admission of successive increments of the running web into and for removal of successive increments of the web from the nip 14.

It is clear that the number of electromagnets in each of the groups S1, etc. can be reduced to less than eight or increased to nine or more. A rather large number of relatively small electromagnets is preferred at this time because they can be more readily accommodated in the interior of the shell 2 and also because the magnetic fluxes generated by small electromagnets are more compact so that the roll 1 can employ a relatively thin shell 2. The wall thickness of such shell need not appreciably exceed 20 mm. While it is also possible to employ groups wherein the electromagnets are not distributed uniformly, as considered in the circumferential direction of the carrier 4, the arrangement which is illustrated in FIG. 2 is preferred at this time because a group of magnets which extends along an arc of 360 degrees allows for a variety of regulations including the regulation of temperature as well as the regulation of resistance which the shell offers to bending and analogous stresses. Moreover, such distribution of electromagnets renders it possible to reduce the resultant magnetic force to any desired value including zero if the magnets are required to perform a heating action but serve no other purpose (such as opposing flexure of the shell).

It has been found that a highly satisfactory heating action can be achieved if the polarities of neighboring electromagnets (as considered in the circumferential direction of the carrier 4) alternate in some or all of the groups S1, etc. This entails highly pronounced changes of magnetic flux when the shell 2 is rotated with the result that the magnets generate correspondingly large eddy currents in the material of the shell 2. However, and as already mentioned above, even if the magnets are installed in such a way that similar poles of all magnets in a group face the internal surface 11 of the shell 2, the respective group can produce highly satisfactory changes of magnetic flux due to the provision of gaps between the pole faces of neighboring electromagnets.

An advantage of the detectors m is that they allow for the utilization of magnetic forces for a purpose which has no direct bearing on the heating action of the roll 1 but is of considerable advantage when the shell 2 is subjected to pronounced bending stresses. Thus, by the simple expedient of properly energizing selected electromagnets, the heating system of the present invention can also oppose undue or any deformation of the shell, namely, any such deformation which is attributable to bending stresses in contrast to expansion or contraction which is attributable to heating or lack of heating. The magnetic forces can also be used to enable the shell 2 to float around the carrier 4, i.e., for the purpose of heating, for the purpose of resisting deformation and also for the purpose of supporting the shell in an optimum position.

As already explained hereinbefore, the sum of magnetic forces which are produced by electromagnets serving exclusively to heat the corresponding portion of the shell 2 will be zero if certain other magnets are used to oppose or prevent flexing of the rotating shell.

The thickness d of the shell 2 could be reduced to 20 mm or less. However, a shell whose thickness at least equals 20 mm is preferred at this time because this ensures that, at least in most instances, the dimension d is at least twice the extent of penetration of eddy currents into the material of the shell. Moreover, the mass of the shell is then sufficiently great to ensure uniform or nearly uniform distribution of temperatures at the external surface 15 even if the distribution of density of magnetic flux is not uniform at all or is less uniform than the desired distribution of temperatures at the surface 15. This holds especially true when the electromagnets of the groups S1, etc. are installed in the interior of the shell 2.

FIG. 3 illustrates a modified calender roll 101 with a hollow cylindrical shell 102. All such parts of the structure shown in FIG. 3 which are identical with or clearly analogous to the corresponding parts of the roll 1 shown in FIGS. 1–2 are denoted by similar reference characters plus 100. The end portions of the shell 102 are connected with the rotors 117, 117' of two discrete electric motors 118, 118' which serve to rotate the shell 102 and which further comprise fixedly mounted stators 119, 119' surrounding the respective rotors. Each of the motors 118, 118' may constitute an asynchronous squirrel cage induction motor. The rotors 117, 117' can replace the magnets I to L of FIG. 2 by effecting a desirable heating of the respective end portions of the sleeve 102. As mentioned above, such heating is desirable in order to prevent an abrupt drop of temperature at the ends of the shell. The frame of the machine which embodies the roll 101 comprises two frame members 105, 105' for the respective end portions of the carrier 104. The shell 102 rotates on bearings 103.

The temperature monitoring devices M' of the embodiment which is shown in FIG. 3 are infrared radiation detectors which are fixedly mounted on the carrier 104 and are interposed between neighboring groups S1 to S6 of annularly arranged electromagnets. The number of groups can be reduced to less than six or increased to seven or more, depending on the length of the roll 101 and on the dimensions of the individual electromagnets. The internal surface 111 of shell 102 is provided with layers 128 which consist of black dulling lacquer and surround the respective monitoring devices M' in order to achieve an optimum radiation effect. The temperature which is ascertained by the devices M' at the internal surface 111 of the shell 102 is in a predetermined relationship with the temperature in the corresponding region of the external surface 115, i.e., the measurement at the surface 111 is tantamount to measurement at the exterior of the shell 102.

The aforementioned stress detectors m are mounted on the carrier 104 between certain groups S of annularly arranged electromagnets. In the embodiment of FIG. 3, the carrier 104 supports three detectors m which are respectively installed between the groups S1-S2, S3-S4 and S5-S6, e.g., diametrically opposite the respective temperature monitoring devices M'. The detectors m may constitute conventional proximity detectors which monitor the distance between the external surface of the respective portion of the carrier 104 and the adjacent portion of the internal surface 111 and transmit signals which are indicative of the extent of bending or flexure of the shell 102. As explained in connection with FIGS. 1 and 2, the outputs of the detectors m can transmit such signals to the inputs 25 of the corresponding circuits R1, etc. so that the signals can influence the resistance which certain magnets in the respective groups of magnets offer to flexing of the shell 102.

The layers 128 of lacquer or the like are desirable because the shell 102 consists of a metallic material and its internal surface 111 is normally finished to a high degree of polish. Such layers invariably guarantee that the rate of heat radiation upon the monitoring devices M' suffices to ensure a highly reliable temperature measurement. Layers consisting of lacquer or certain other plastic materials are preferred at this time.

Figure 4:
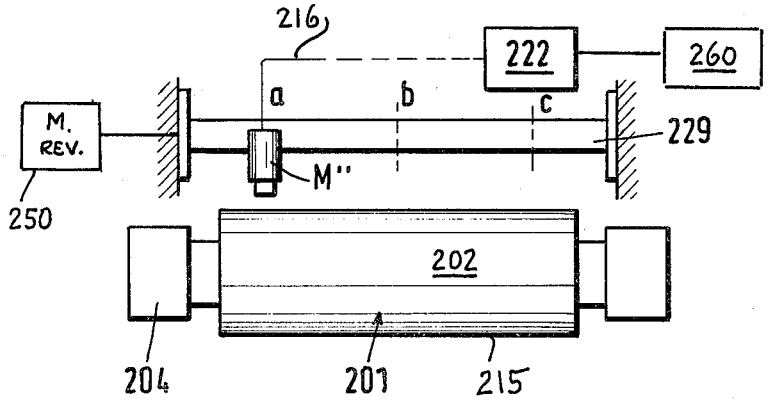
FIG. 4 is a schematic elevational view of a calender roll and of a modified device for monitoring the temperature at the external surface of the shell forming part of the calender roll.

FIG. 4 illustrates a further roll 201 which may be constructed and assembled in the same way as the roll 1 or 101 except that the temperature at selected locations of the external surface 215 of the shell 202 is ascertained by a single monitoring device M'' which is mounted on a guide member 229 (e.g., an elongated rail) and is movable back and forth by a motor 250 of any suitable design, e.g., through the medium of a feed screw and a nut on the device M''. The arrangement is preferably such that the motor 250 constitutes a stepping motor which intermittently drives the detector M'' so that the latter remains at a standstill in a selected number of positions (indicated at a, b and c) in order to ascertain the temperature of the adjacent portion of the external surface 215. Signals which are generated by the detector M'' are transmitted to the control circuit 222 by flexible conductor means 216 .

An advantage of the roll of FIG. 4 is that a single monitoring device suffices for ascertainment of temperatures at a desired number of locations along the external surface of the roll 201. On the other hand, the rolls of FIGS. 1–2 and 3 exhibit the advantage that the temperature monitoring means are less prone to malfunction because the devices M1, etc. or M' are fixedly mounted adjacent to or in the interior of the shell. Moreover, the fixedly mounted temperature monitoring devices can be installed in spaces which are readily available in or around the shell and would otherwise remain unoccupied.

The improved roll and its heating system are susceptible of many additional modifications without departing from the spirit of the invention. For example, instead of being connected to a source of direct current, the circuits T1, etc. can supply the windings of the electromagnet with alternating current or with polyphase current. A source of current (which may constitute a source of direct current, a source of polyphase current or a source of alternating current) is denoted in FIG. 4 by the reference character 260.

The regulating circuits T may comprise a discrete regulating unit for each magnet of each group S, a discrete regulating unit for two or more magnets in a group, a discrete regulating unit for each group of magnets, or a common regulating unit for two or more groups of magnets.

The neighboring magnets in each of the groups S can have alternating polarities.

If desired, the illustrated monitoring devices M1, etc., M' and M'' can be replaced by or may constitute means for measuring the internal or external diameters of selected portions of the respective shells. The diameters are indicative of the temperature of corresponding portions of the shell. Proximity detectors (such as the aforediscussed detectors m) can be used with advantage as a means for monitoring the diameters of the shells in rolls which embody or are combined with the heating system of the present invention.

The regulating circuits can vary the intensity of current which is supplied to the respective windings. Alternatively, the regulating circuits can be designed to vary the direction of current flow in the respective windings. Still further, the regulating circuits may include means for varying the amplitude and/or frequency of alternating or polyphase current if such current is supplied to the windings of the electromagnets. Furthermore, the windings can be supplied with constant or variable direct current in addition to alternating or multiphase current. Still further, the RPM of the shell can be regulated in dependency on changes in temperature of the shell.

The monitoring device or devices can be designed to ascertain the slip frequency of the rotating field (which is generated by a polyphase current) with reference to the RPM of the shell and/or the amplitude of the polyphase current.

If the magnets A to H are permanent magnets, the regulating means T1, etc. can be designed as a means for effecting appropriate radial adjustments of the permanent magnets with reference to the carrier 4. If the groups S1, etc. rotate, the regulating means T1, etc. can include means for varying the RPM of rotating groups. However, and since the magnets A to H are preferably electromagnets, the regulating means T1, etc. normally constitute circuits which can influence the excitation currents for the windings 8. If the current is a direct current, the regulating circuits will change the intensity and/or the direction of current flow from electromagnet to electromagnet (as considered in the circumferential direction of the respective groups) or from one pair of neighboring or otherwise positioned electromagnets to the next pair. In this manner, one can vary the magnetomotive force or magnetic flux (either uniformly or non-uniformly) from electromagnet to electromagnet or from a first series to the next series of electromagnets. The regulating means can be designed to disconnect selected magnets or sets of magnets from the source of electrical energy.

Without further analysis, the foregoing will so fully reveal the gist of the present invention that others can, by applying current knowledge, readily adapt it for various applications without omitting features that, from the standpoint or prior art, fairly constitute essential characteristics of the generic and specific aspects of our contribution to the art and, therefore, such adaptations should and are intended to be comprehended within the meaning and range of equivalence of the appended claims.

We claim:

1. A roll, particularly a calender roll, comprising a rotary hollow cylindrical shell consisting of ferromagnetic material and having an external surface and an internal surface; and heating means for said shell, including a plurality of groups of electromagnets adjacent to at least one of said surfaces, surrounding the axis of said roll and with the axis of said shell, at least a portion of the external surface of said shell being unobstructed by said electromagnets and each of said groups comprising a plurality of discrete neighboring electromagnets and the neighboring electromagnets of said groups having different polarities and being distributed in the circumferential direction of said shell, each of said electromagnets having a winding and being arranged to induce a magnetic flux in the respective portion of said shell, a source of d-c current for the windings of said electromagnets, adjustable means for regulating the magnetic flux which is induced by the electromagnets of at least some of said groups independently of the magnetic flux induced by the other groups, said regulating means including means for varying the intensity of current which is supplied to said windings, signal generating monitoring means for ascertaining the temperature of a plurality of locations along said external surface, as considered in the axial direction of said shell, and control means having input means connected with said monitoring means and arranged to adjust said regulating means so as to maintain a predetermined pattern of temperature along said external surface.

2. The roll of claim 1, further comprising a stationary carrier for said shell, said shell spacedly surrounding said carrier and said groups including electromagnets installed on said carrier within the confines of said shell.

3. The roll of claim 1, wherein said shell has first and second end portions and further comprising stationary additional magnets externally adjacent to said shell in the region of at least one of said end portions.

4. The roll of claim 1, wherein said shell has a first and a second end portion and further comprising means for rotating said shell, said rotating means including at least one electric motor having a rotor connected with one of said end portions and a fixed stator surrounding said rotor.

5. The roll of claim 1, wherein said regulating means comprises discrete regulating units for at least two electromagnets of each of said groups.

6. The roll of claim 1, wherein the electromagnets of each of said groups form a complete annulus of uniformly distributed electromagnets as considered in the circumferential direction of said shell.

7. The roll of claim 1, wherein said monitoring means comprises means for measuring the diameter of said shell.

8. The roll of claim 1, wherein said electromagnets are arranged to induce eddy currents in the material of said shell and said monitoring means comprises means for monitoring said currents to thereby ascertain those changes of the characteristics of the material of said shell which are attributable to changes in temperature.

9. The roll of claim 1, further comprising at least one signal generating stress detector arranged to monitor the magnitude of stresses upon said shell at a plurality of locations, as considered in the axial direction of said shell, said control means having additional input means for the signals which are transmitted by said detector means and said control means being arranged to adjust said regulating means as a function of the intensity of signals from said detector means.

10. The roll of claim 1, wherein said electromagnets generate eddy currents which penetrate into a portion of said shell, the overall thickness of said shell being at least twice the thickness of said portion thereof, as considered in the radial direction of said roll.

11. The roll of claim 10, wherein said overall thickness is at least 20 mm.

12. The roll of claim 1, wherein said monitoring means is movable in substantial parallelism with the axis of said shell and further comprising means for moving said monitoring means with reference to said shell.

13. The roll of claim 1, wherein said monitoring means comprises at least one fixedly mounted monitoring device for each of said groups.

14. The roll of claim 1, wherein said monitoring means comprises a monitoring device between each pair of neighboring groups of electromagnets.

15. The roll of claim 1, wherein said monitoring means comprises at least one infrared radiation detector.

16. The roll of claim 15, wherein said detector is installed within the confines of said shell.

17. The roll of claim 16, wherein said internal surface includes a portion which is adjacent to said detector and is arranged to effect pronounced radiation of the infrared heat upon said detector.

* * * * *